United States Patent [19]

Norman et al.

[11] Patent Number: 4,675,029

[45] Date of Patent: Jun. 23, 1987

[54] APPARATUS AND METHOD FOR TREATING THE EMISSION PRODUCTS OF A WOOD BURNING STOVE

[75] Inventors: Dan A. Norman, Auburn; Stanley J. Frazier, Bellevue, both of Wash.

[73] Assignee: GeoEnergy International, Corp., Tukwilla, Wash.

[21] Appl. No.: 674,050

[22] Filed: Nov. 21, 1984

[51] Int. Cl.[4] ..... B03C 1/00

[52] U.S. Cl. ..... 55/11; 126/77; 110/216; 55/135; 55/140; 55/152; 55/154

[58] Field of Search ..... 55/11, 13, DIG. 30, 55/135, 150–153, 154, 312–314, 268, 269; 126/77, 299 F; 110/216, 119–122; 237/55; 165/DIG. 2

[56] References Cited

U.S. PATENT DOCUMENTS

| | | | |
|---|---|---|---|
| 1,371,995 | 3/1921 | Nesbit . | |
| 1,393,712 | 10/1921 | Steere et al. . | |
| 1,473,806 | 11/1923 | Bradley . | |
| 1,826,428 | 10/1931 | Miller . | |
| 1,884,085 | 10/1932 | Miller . | |
| 1,895,676 | 1/1933 | Miller . | |
| 2,215,807 | 9/1940 | Perry | 55/135 |
| 2,362,940 | 11/1944 | Skerritt | 237/55 |
| 2,711,225 | 6/1955 | Armstrong et al. . | |
| 2,722,283 | 11/1955 | Klemperer et al. . | |
| 3,173,980 | 3/1965 | Hysinger | 55/314 |
| 3,656,440 | 4/1972 | Grey . | |
| 3,656,441 | 4/1972 | Grey et al. . | |
| 3,924,547 | 12/1975 | Werner . | |
| 4,050,627 | 9/1977 | Mayer | 165/DIG. 2 |
| 4,110,086 | 8/1978 | Schwab et al. . | |
| 4,194,888 | 3/1980 | Schwab | 55/152 |
| 4,247,307 | 1/1981 | Chang | 55/152 |
| 4,305,909 | 12/1981 | Willett et al. | 55/11 |
| 4,313,562 | 2/1982 | White | 237/55 |
| 4,406,277 | 9/1983 | Russo | 126/77 |
| 4,478,613 | 10/1984 | Brettschneider | 55/152 |

FOREIGN PATENT DOCUMENTS

| | | | |
|---|---|---|---|
| 103160 | 12/1925 | Austria | 55/135 |
| 1170526 | 7/1984 | Canada . | |
| 727090 | 6/1932 | France . | |
| 1282931 | 12/1961 | France | 55/135 |
| 323186 | 12/1929 | United Kingdom | 55/135 |
| 2005158 | 4/1979 | United Kingdom . | |
| 2081886 | 2/1982 | United Kingdom . | |

*Primary Examiner*—Bernard Nozick
*Attorney, Agent, or Firm*—Hughes & Cassidy

[57] ABSTRACT

A pollutant removal/heat exchange apparatus is mounted to a wood burning stove to receive the emission products from the stove. The apparatus comprises a plurality of vertically aligned tubular electrodes which define vertical through passageways. Negatively charged disc-like electrodes are positioned within the tubular electrodes. Partially burned hydrocarbons and moisture in the emission products become negatively charged as they pass through the tubular electrodes to become deposited on the inner surfaces of the tubular electrodes. Ambient air is directed through the passageways between the tubular electrodes to extract heat from the emission products, with the heated air being discharged from the apparatus. The electrostatic precipitation of the material on the tubular electrodes not only removes undesired material from the emission products, but also enhances heat exchange with the ambient air passing through the apparatus.

50 Claims, 13 Drawing Figures

APPARATUS AND METHOD FOR TREATING THE EMISSION PRODUCTS OF A WOOD BURNING STOVE

TECHNICAL FIELD

The present invention relates generally to an apparatus and method for treating combustion products, and more particularly for treating combustion products such as those emitted from a wood burning stoves, or other wood burning appliances for residential heating.

BACKGROUND OF THE INVENTION

It has been a common practice for many centuries to burn wood to heat a home or other building structure. Further, for at least more than two centuries, there have been various efforts to burn the wood more effectively. For example, in 1740, Benjamin Franklin designed his "Pennsylvania Fire-place" to extract more heat from the burning of the wood, with the hope of alleviating the problem of the then existing fuel wood shortage around Philadelphia. In Benjamin Franklin's design, the gaseous combustion products from the wood burning fire were directed first upwardly, and then downwardly around a heat exchange apparatus, after which the gaseous exhaust was discharged upwardly through a chimney. At the same time, air was circulated from the cellar upwardly through a heat exchange apparatus to heat the room. Even at that time, Benjamin Franklin recognized that permitting too much ambient air to go up the chimney without contributing to the combustion was wasteful of the heat energy. He thus provided a shutter that slid in grooves to limit the draft of air into the wood burning chamber. He also recognized that a "dirty" fire was less efficient in producing heat.

In 1836, Isaac Orr patented his "airtight" stove. By controlling the amount of air which is drawn into the wood burning chamber, the unnecessary loss of hot air flowing up the chimney could be alleviated to some extent. Since that time, there have been hundreds, if not thousands, of proposals and designs to promote more complete combustion of the wood products, as well as to promote more effective heat exchange of the combustion products (i.e. preventing the heat from simply going up the chimney).

There are other problems which might be considered as inherent in the burning of wood. For instance, wood that is considered quite dry (e.g. split logs that have been air dried for a number of months in warm summer weather) can still contain as much as 20% water by weight. In the burning process, this moisture evaporates, and the passage of this evaporated moisture up the chimney represents lost heat.

Another complicating factor is that about half of the potential heat value in the wood is in the form of "volatiles", which are combustible gasses which are given off when the wood gets hot. When a piece of wood is placed in the wood burning chamber of a fireplace, as the temperature of the wood rises, first the water in the wood is evaporated in the form of steam, and some volatiles may be evaporated. When the wood reaches the temperature of about 300°-400° F., the wood begins to break down chemically, and this generates yet more volatiles in the form of gaseous organic molecules. Unfortunately, complete combustion of these volatiles can be accomplished in normal circumstances only if the temperature could rise to as high as 1000° F. However, this is not always practical for a number of reasons.

There have been various attempts to improve the combustion of volatiles, and many of these have focused on what can be termed "secondary combustion". For example, the gaseous combustion products emanated from the location of the burning wood are redirected into a secondary zone where additional ambient air is introduced to enhance combustion of the volatiles.

Further, in the common wood burning stove that is used in normal conditions in a person's home, there are certain practical difficulties in attempting to "fine tune" the operation of the stove to extract the heat effectively. For example, the person burning wood as a source of heat does not want to be constantly attending the wood stove by feeding in only the amount of wood which is needed to produce the desired amount of heat for a short period of time. Rather, the person will generally stack up the wood in the fireplace and then leave the stove to burn for possibly several hours. However, if the stove is permitted to burn "wide open", heat may be generated too rapidly, thus raising the room temperature to an undesirably high level. This problem is commonly solved by regulating the draft of the stove to limit the amount of air which enters the stove. In some stoves, the flow of air into the stove can be regulated automatically, such as by use of a temperature sensitive control device. One such device is the bimetallic strip used in an automatic draft control device, this being developed by Elisha Foote of Geneva, N.Y. in approximately 1872.

However, when the draft is limited, this necessarily reduces the amount of oxygen available for complete combustion of the volatiles, and these volatiles pass unburned up the chimney. As the volatiles cool as they pass up the flue or chimney, some of these become deposited on the inside surfaces of the flue or chimney in the form of creosote. It sometimes happens that when the fire is later burning at a very high temperature, high temperature combustion products pass up the flue to ignite the accumulated creosote, thus resulting in what is commonly called a "chimney fire".

Another problem which is related to the problems noted above, and which has become more serious in recent years is the pollution which can be generated by wood burning stoves. The partially burned hydrocarbons not only introduce toxic waste into the air, but also emit highly visible smoke which is aesthetically unpleasing as it is environmentally hazardous. One approach to this problem is to burn the wood, including the volatiles, more completely. However, as indicated above, this has certain practical problems. Another approach to alleviate this problem has been to utilize catalytic converters to limit the quantity of these emissions. However, in order to avoid catalytic fouling, these catalytic converters are commonly bypassed during the initial startup of the stove until the firebox temperature reaches approximately 500° F. Unfortunately, it is during this startup period that the greatest quantity of contaminants are discharged on a per hour basis. In addition, catalytic converters have a limited useful life span and must therefore be replaced periodically.

Another consideration is that it is not practical to direct the emissions from a wood burning stove through various conduits and treatment sections to process the gaseous exhaust. For a wood burning stove to operate effectively, it must "draw" adequately (i.e. there must be a sufficiently strong flow of gaseous material up the flue or chimney). If this is not accomplished, when the person opens the stove to insert more wood, there is sometimes a puff or strong flow of a relatively large volume of smoke out of the door of the firebox and into the room.

With regard to the broad subject of treating gaseous effluent of various sorts to remove contaminants, recover certain ingredients, etc., there have been various avenues that have been explored over the decades. One of these is the use of electrostatic precipitators which have been commonly used to remove particulate matter from gaseous emissions of industrial plants and other installations. Commonly, the emissions are passed between a pair of electrodes, one of which is usually grounded. The other electrode is charged to a higher negative voltage relative to the grounded electrode so that an electric field is established between the two electrodes; the electric field being sufficiently strong to ionize the emissions between the electrodes, a phenomenon known as "corona discharge". The corona discharge from the negatively charged electrode imparts a negative charge to many of the particulate emissions passing between the electrodes, which are then caused to migrate under the force of the electrostatic field toward the grounded electrode. The particulate emissions collected on the grounded electrode are then removed therefrom in some suitable manner.

There are various types of conventional electrostatic precipitators. One relatively simple precipitator includes a grounded electrode in the form of two parallel spaced plates with negatively charged wires spaced therebetween, and wherein gaseous effluents are passed between the area defined by the two plates. Another type of electrostatic precipitator comprises a grounded electrode configured as a cylinder with a negatively charged electrode comprising a wire which extends along the axial centerline of the tubular cylindrical electrode, and wherein charged particulate emissions are conducted onto the inner surface of the outer tubular electrode by an electrostatic field induced between the wire cathode and the tubular anode.

Another prior art electrostatic precipitator is disclosed in U.S. Pat. No. 4,194,888—Schwab et al, wherein a grounded electrode is configured as a cylinder with the negatively charged electrode comprising an inner elongated support electrode connected to one or more disc-shaped discharge electrodes having a transverse dimension larger than the transverse dimension of the support electrode. The disc electrodes are spaced apart along a support electrode to provide multiple charging and collection zones through which the emissions sequentially pass.

In U.S. Pat. No. 4,110,086—Schwab et al, there is disclosed an electrostatic precipitator for removing contaminants from gaseous streams wherein the electrostatic precipitator includes a central disc electrode located concentrically within a venturi throat, the venturi acting as an outer electrode.

In U.S. Pat. No. 3,656,441—Grey et al, there is disclosed an incinerator and two separating chambers to remove the contaminants from the incinerator emission gasses, and a liquid-wash medium which washes the inner walls of the first separating chamber to remove contaminants precipitated thereon. The liquid-wash medium also cools the emission products to a temperature of between 400°-600° F. to reduce the concentration of gaseous contaminants prior to passing the emission products through a second separating chamber. Electrostatic precipitation takes place within the second separating chamber, the second separating chamber subject to water wash down on the inner walls thereof to remove collected contaminants.

In U.S. Pat. No. 1,884,085—Miller, there is disclosed an electrostatic precipitator for removing certain constituents of emission products from a coke oven wherein a precipitation zone is heated to an elevated temperature by circulating a heating medium about an electrode tube. The emission products are maintained therein at a temperature which permits certain components to remain in the gaseous phase while causing other components to condense.

In U.S. Pat. Nos. 1,895,676—Miller, and 1,826,428, there is disclosed apparatus similar to that disclosed in the above described Miller Patent, U.S. Pat. No. 1,884,085.

In U.S. Pat. No. 4,289,504—Steere et al, there is disclosed apparatus for removing wax-like particulate matter from emissions wherein electrical heating means are provided in the outer surface of a collecting box to maintain the fluidity of normally non-fluid material removed from the emissions. Other U.S. patents disclosing electrostatic precipitators used to separate certain constituents from emissions including U.S. Pat. Nos. 3,656,440—Grey et al; 2,722,283—Klemperer et al; 2,711,225—Armstrong et al; 1,473,806—Bradley; and 1,393,712—Steere et al.

SUMMARY OF THE INVENTION

The apparatus and method of the present invention relate to the treating of emission products resulting from burning a fuel product, such as wood, in a manner to remove pollutants from the emission products and to improve heat exchange relative to such emission products.

The method of the present invention is performed under conditions where a fuel product, such as wood, is burned in a combustion chamber of a heating unit, such as a firebox of a wood burning stove, for producing heat, such as producing heat for a building structure, and where the emission products from the burning fuel contain, during at least a portion of time during which the fuel is burning, an excess amount of incompletely burned hydrocarbons above a predetermined content level.

The emission products from the heating unit are directed through an electrostatic precipitator unit on a through path where the emission products flow between a first electrode and a second electrode. The first electrode has a first collecting surface along which the emission products flow.

The second electrode is charged negatively to a predetermined voltage level relative to the first electrode to create corona discharge from the second electrode to cause material, including at least a portion of the excess incompletely burned hydrocarbons, to become deposited on the collecting surface of the first electrode. The deposited material is caused to be removed from the first collecting surface of the first electrode.

The method of the present invention is particularly adapted to treat the emission products from a heating unit where the rate of combustion of the fuel produced is controlled by selectively limiting air intake into the combustion chamber of the heating unit.

Desirably, the deposited material is at least partially removed by positioning the first electrode so that its first collecting surface has a substantial vertical component of alignment, and the deposited material is removed by gravity flow from the first collecting surface. In the preferred form, the temperature at the first electrode is maintained at a level where the collected material on the first electrode is at least partially liquid, with the collected material flowing by gravity from the first surface of the first electrode. Preferably, the temperature at the first electrode is maintained at a level below the boiling point of water, whereby at least a portion of moisture in the emission products collects on the surface of the first electrode as at least part of the collected material to flow downwardly from the first electrode.

Tray means are provided at a location vertically below the first electrode. The deposited material which moves downwardly from the first electrode is collected on the tray means. Also, in one form of the invention, the precipitator unit is positioned relative to the combustion chamber so that the deposited material that moves downwardly can be directed back to the combustion chamber where it can be burned further.

A heat exchange medium is passed in heat exchange relationship with a second heat exchange surface of the first electrode to maintain the temperature of the first electrode at the desired level. In the preferred form, the first electrode is a tubular electrode, and the second electrode is positioned within the first electrode. The first surface is the interior surface of the first tubular electrode, and the second surface is the exterior surface of the first tubular electrode. In the preferred embodiment, there are a plurality of such precipitator units, with the heat exchange passageway being located between the precipitator units. In the preferred embodiment, ambient air is utilized as the heat exchange medium, and there is fan means to cause the air to flow through the heat exchange passageways. The flow of the air is controlled to maintain the temperature of the first electrode within a predetermined range, and this can be accomplished by employing variable speed fan means.

The preferred form of the electrostatic precipitator is such that the second electrode has at least a portion thereof extending radially outwardly from a center location within the first tubular electrode to form a radially outward corona discharge edge portion. This second electrode thus forms a radially outwardly expanding electrostatic field to enhance electrostatic precipitation and thus improve collection of the incompletely burned hydrocarbons on the first collecting surface of the first electrode.

With regard to the positioning of the portion of the second electrode that extends radially outwardly from the second location, these electrode portions are positioned in an upper portion of the first electrode. The heat exchange medium is passed in heat exchange relationship with both the upper and a lower portion of the first electrodes. Thus the emission products are cooled prior to passing through the electrostatic field provided by the second electrodes.

In accordance with a modified version of the present invention, there is provided a bypass passageway which directs the emission products around the precipitator unit. There is also damper means to selectively control the flow of emission products either through the precipitator means or to bypass the precipitator means. When the emission products are at a very high temperature, it may be desirable to bypass the electrostatic precipitator to avoid its being raised to an excessively high temperature.

Other features of the present invention will become apparent from the following detailed description.

BRIEF DESCRIPTION OF THE DRAWINGS

These and other objects and advantages of the present invention will become more readily apparent upon reading the following detailed description and upon reference to the attached drawings, in which.

Figure 1:
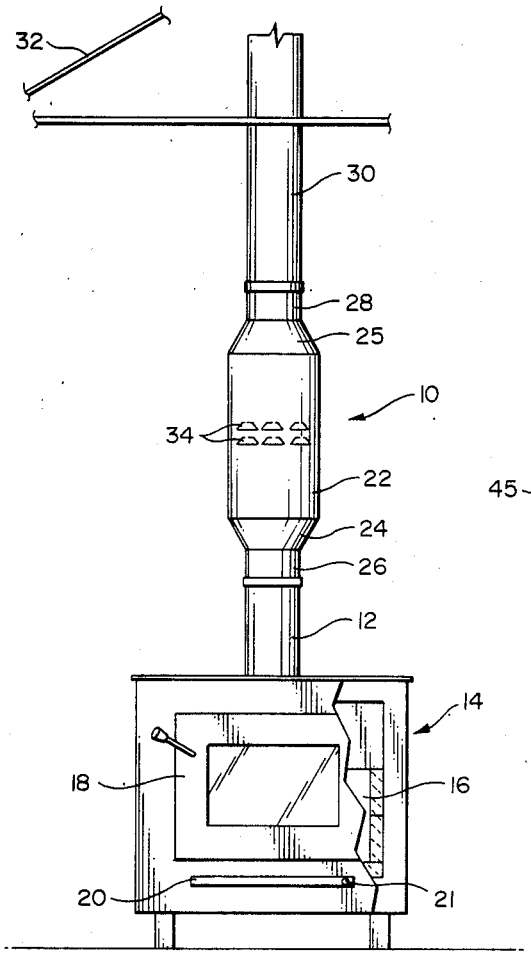
FIG. 1 is a front elevational view showing the apparatus of the present invention interposed between a wood burning stove and an exhaust conduit.

While the present invention is susceptible of various modifications and alternative forms, specific embodiments thereof have been shown by way of example in the drawings and herein will be described in detail. It should be understood, however, that it is not intended to limit the invention to the particular forms disclosed, but, on the contrary, the intention is to cover all modifications, equivalents and alternatives falling within the spirit and scope of the invention.

DETAILED DESCRIPTION

The present invention is particularly adapted for use in treating the exhaust or effluent that results from the burning of wood, such as in a wood burning stove or the like. Therefore, in the following description, the present invention will be described with reference to the particular problems encountered in the normal operation of a wood burning stove that is used to produce heat for a home or other building structure, with the understanding that the present invention could have somewhat broader applications where problems are encountered similar to those described herein.

In FIG. 1, the apparatus 10 of the present invention is shown mounted to the flue 12 of a conventional wood burning stove 14. This stove 14 defines a firebox or combustion chamber 16, and has a front door 18 through which the logs or other wood pieces can be inserted into the firebox 16 of the stove 14. In addition, the stove 14 has an air vent device 20 which can be utilized to control the inflow of air into the combustion chamber 16. This air vent device 20 can be manually operated, such as by a slidable element which is operated by a knob 21 and which opens up or closes down the vent opening. Alternatively, this device 20 could be controlled in some other manner, such as by a thermostat (e.g. in the form of a bimetal elexent) which opens further or shuts down in response to temperature in the combustion chamber 16.

The apparatus 10 comprises a cylindrical housing 22 having tapered lower and upper inlet and outlet portions 24 and 25, respectively. It is to be understood that the housing 22 could have different configurations, such as a box-like configuration, or possibly a configuration where the width dimension of the apparatus substantially exceeds its thickness dimension, as in the embodiment of FIGS. 8–10. Further, while the present invention is shown being mounted directly above a wood burning stove, it could be placed at other locations to receive the emissions from the stove 14, or be used in conjunction with other burning devices having operating problems such as those described herein. The lower housing portion has a cylindrical inlet 26 which connects to the upper end of the flue section 12. The upper housing section 25 has a cylindrical outlet 28 which connects to the lower end of an upper exhaust conduit 30 which leads upwardly through the building roof 32 to discharge the gaseous exhaust from the stove 14 into the atmosphere. The front wall of the housing 22 is formed with a number of louvered heat vents 34 through which hot air is discharged into the room for which the stove 14 is providing heat. The manner in which this is accomplished in the present invention will be discussed later herein.

Figure 3:
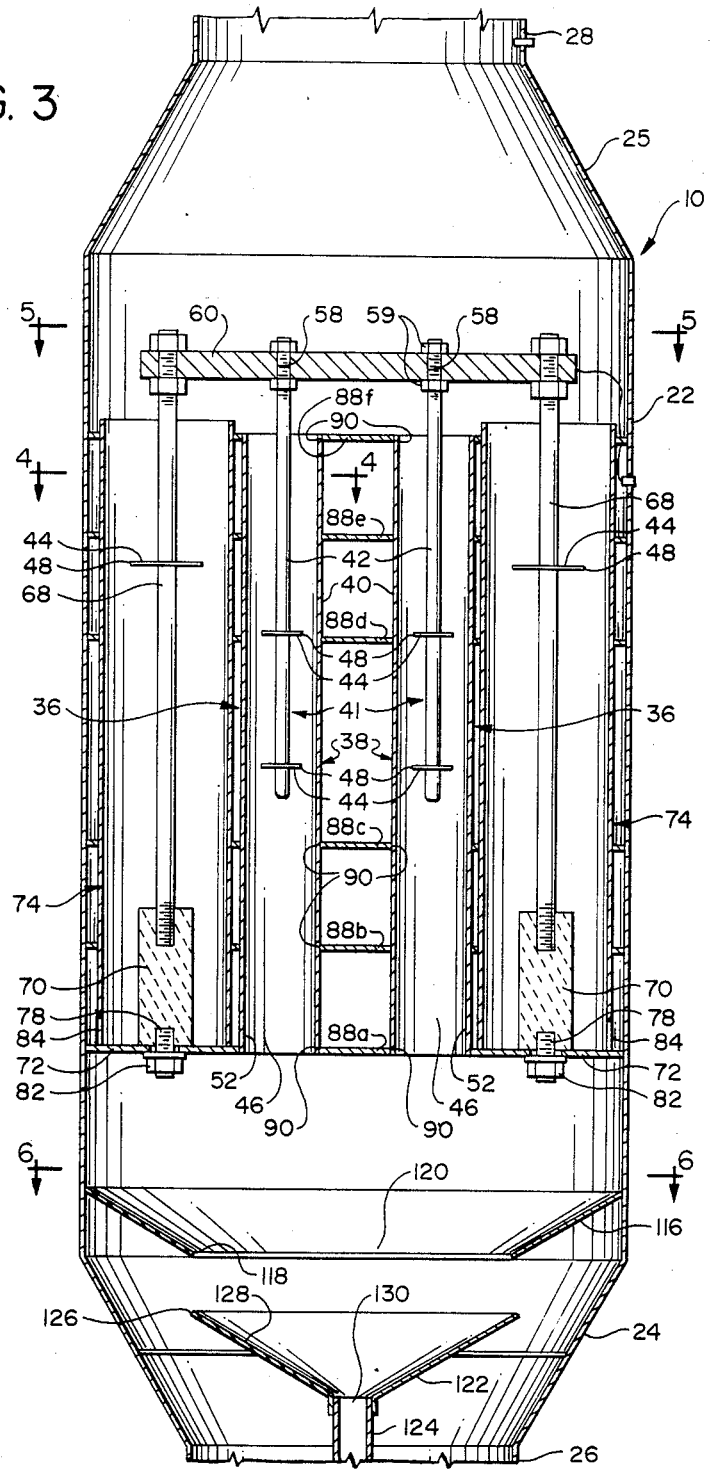
FIG. 3 is a cross-sectional view of the apparatus of the present invention taken along the vertical center axis of the apparatus.

With reference to FIG. 3, which is a front sectional view of the apparatus 10, there is shown an electrostatic precipitator 36, which is made up of a plurality of precipitator units 38. Each of the units 38 comprises a tubular, generally cylindrical electrode, with the several tubular electrodes 40 being positioned at predetermined spaced locations within the housing 22.

The longitudinal axes of tubular electrodes 40 are vertically aligned so as to be parallel to the longitudinal axis defined by the centerlines of inlet 26 and outlet 28 to receive the flow of emission products from combustion chamber 16 therethrough. Inside each electrode 40 there is an inner discharge electrode 41 comprising a support electrode in the form of a rod 42 axially aligned with and centered within its related tubular electrode 40 (FIG. 4), and at least one disc electrode 44 secured to support the electrode 42 proximate to the lower end thereof.

In the particular embodiment shown herein, there are two disc electrodes 44 mounted to each support electrode 42, with the disc electrodes 44 being spaced one above the other. The plane occupied by each disc electrode 44 is perpendicular to the longitudinal axis of its related support electrode 42. The precipitator units 38 made up of the tubular electrodes 40, support electrode 42 and disc electrodes 44 have been found to operate quite effectively in the present invention, and these units 38 are described in further detail in U.S. Pat. No. 4,194,888—Schwab et al, which is incorporated herein by reference in its entirety.

Figure 4:
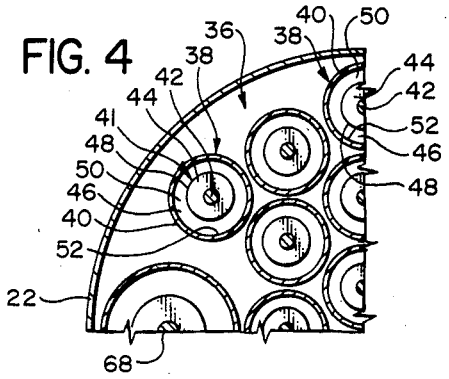
FIG. 4 is a partial cross-sectional top view of the apparatus taken along line 4—4 of FIG. 3, showing the tubular electrodes and disc support rods.

Tubular electrode 40 is a grounded anode which defines therein a vertically aligned through-passage 46 to receive the emission products which are traveling upward from combustion chamber 16. Each support electrode 42 and disc electrode 44 are raised to a sufficiently high voltage by a voltage source 43 (FIG. 2) via an "on/off" switch 45 to create an intense electrostatic field between peripheral edge portions 48 of each disc electrode 44, as shown in FIG. 4, and the related tubular electrode 40. Also the power source 43 is desirably provided with a safety switch that would shut the power supply 43 off when the electrostatic precipitator 36 is being removed or under other circumstances where a person might come in contact with or close to the electrically charged components. As the emission products travel through an annular gap 50 (FIG. 4) defined by perimeter 48 and tubular electrode 40, a portion of the emission products, which normally includes condensed water, is caused to collect on the inner surface 52 of each tubular electrode 40.

Figure 5:
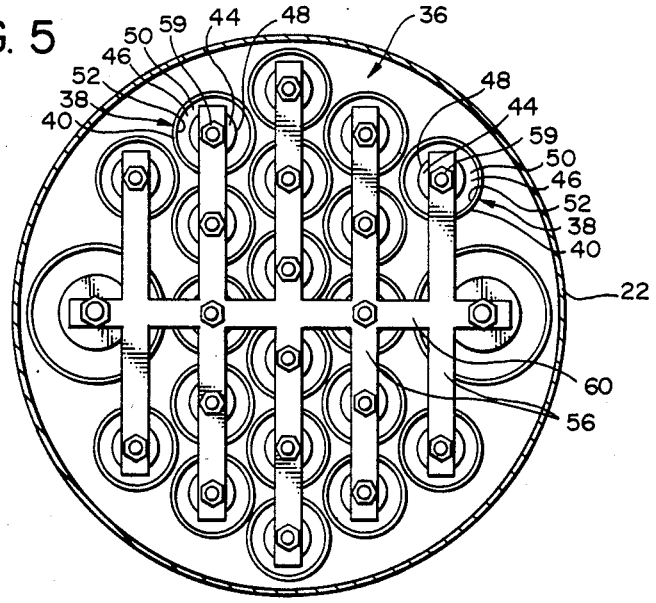
FIG. 5 is a full cross-sectional top view of the apparatus taken along line 5—5 of FIG. 3 showing bus bars and a bus support bar.

In order to suspend support electrodes 42 inside tubular electrodes 40 and to supply a negative voltage thereto, there is provided a plurality of bus electrodes 56 shown in FIG. 5 positioned above tubular electrodes 40 and perpendicular to the longitudinal axes thereof. Referring to FIG. 3, bus electrodes 56 secure support electrodes 42 at the upper ends thereof by interposition of support electrodes 42 through apertures 58 of bus electrode 56; support electrodes 42 secured thereto by suitable means, such as by nuts 59 or by making a welded connection. The diameter of a portion of support electrode 42 located within aperture 58 may be sized sufficiently smaller than the diameter of aperture 58 to permit lateral movement of support electrode 42 therewithin to center disc electrode 44 within tubular electrode 40. Bus bars 56 are rigidly engaged by bus support bar 60; bus support bar 60 and bus electrodes 56 are aligned in a common horizontal plane wherein bus bar 60 is perpendicular to bus electrodes 56 (FIG. 5). Bus support bar 60 is charged to a negative voltage by voltage source 43 (FIG. 2) having a voltage output in the range of ten to fifteen kilovolts; bus support bar 60 is charged via an insulated connector (not shown for ease of illustration) extending through the housing 22 and connecting to the power supply 43.

With reference to FIG. 3, support of bus support bar 60 is provided by two bus support rods 68 which respectively engage bus support bar 60 at opposite ends thereof. Each support rod 60 is rigidly engaged in a vertically upright manner by a mounting insulator 70 which is supported by a mounting platform 72 secured to the inner surface of a tubular isolation housing 74, which can also function as a grounded electrode. Mounting insulator 70 which is made of a nonconducting material such as porcelain, and which insulates bus support rod 68 and bus support bar 60 from ground potential. Mounting insulator 70 includes a mounting bolt 78 projecting from the bottom thereof which extends through a mounting aperture of platform 72; a nut 82 engages mounting bolt 78 to secure mounting insulator 70 to platform 72. The diameter of bolt 78 may be sized sufficiently smaller than the diameter of the aperture in the platform 72 to permit centering of bus support rod 68 and mounting insulator 70 within isolation housing 74.

The isolation housings 74 are sealed at the lower ends thereof by the platforms 72 which block the entry of emission products therein to prevent grounding bus support rod 68. In addition, bus support rod 68 may or may not include a discharge electrode 44 which is charged to a sufficiently large negative voltage via bus electrode 56 and support rod 68 to create an electrostatic field between discharge electrode 44 and grounded tubular insulation housihg 74, thereby precipitating any particulate emissions which may accidentally enter the interior of tubular insulator housing 74 due to any turbulent flow of emission products within the housing 22. Each tubular isolation housing 74 may have an aperture 84 at its lower end through which a small percentage of cooling air used as the heat transfer medium, defined below, can pass into the inner chamber of tubular isolation housing 74 and pass up the chamber of the housing 74 to purge the chamber of the housing 74 of any emission products and thus help maintain the isolation cleanliness of the tubular isolation housing 74.

The heat exchange aspects of the present invention will now be described with reference to FIG. 7. For convenience of illustration, the precipitator units 38 and the isolation housing members 74 are not fully illustrated in FIG. 7. Rather, there is illustrated schematically in broken lines only a single precipitator unit 38, this being shown somewhat schematically in FIG. 7.

Extending horizontally across the interior of the main housing 22 are a plurality of horizontally aligned plates 88 which are positioned at vertically spaced locations in the housing 22. Each plate 88 is formed with a plurality of cylindrical openings or cutouts 90 (shown in FIG. 3, but not shown in FIG. 7) to receive the tubular electrodes 40 and also the two mounting electrodes 74. In the particular embodiment shown herein, there are six such plates 88, and these are designated 88*a*–88*f*, with the lowermost plate being designated 88*a*, and the topmost plate designated 88*f*. These plates 88*a–f* serve several functions. First, there is a structural function in that the plates 88*a–f* help hold the tubular electrodes 40 and isolation housings 74 securely in place. Second, these plates 88*a–f* define horizontally aligned heat exchange passageways. Third, the lowermost plate 88*a* blocks off the areas between the tubular electrodes 40, and housing 74, and also the areas between the electrodes 40, housing 74 and the housing 22, so that all of the effluent or gaseous exhaust passing upwardly from the wood stove 14 passes upwardly through the interior of the tubular electrodes 40. The lowermost plate 88*a* is positioned at the lower edges of the electrodes 40, while the topmost plate 88*f* is positioned at the upper edges of the tubular electrodes 40. The topmost plate 88*f* totally closes off the upper portion of the housing 22, except that it leaves the upper ends of the tubular electrodes 40 and housing 74 open. The intermediate plates 88*b–e* each have an edge portion thereof spaced a moderate distance from a wall of the housing 22 so as to define related openings which interconnect the horizontally aligned heat exchange passageways defined by the plates 88*a–f*.

More specifically, in the specific arrangement shown herein, there are five horizontally aligned heat exchange passageways 92*a–e*, with 92*a* being the lowermost passageway, and the 92*e* being the topmost passageway. With reference to FIG. 7, it can be seen that the forward edge of the plate 88*e* is spaced a moderate distance rearwardly of the front wall 94 of the housing 22 so as to provide a through opening (d,e) which interconnects heat exchange passageways 92*e* and 92*d* at the forward ends thereof. The plate 88*d* has the rear edge thereof spaced a moderate distance forwardly of the rear wall 98 of the housing 22 to provide a rear opening (d,c) which interconnects the rear ends of the two heat exchange passageways 92*d* and 92*c*. In like manner, the forward end of the plate 88*b* is spaced rearwardly from the front housing wall 94, and the rear edge of the plate 88*c* is spaced forwardly a moderate distance from the rear housing wall 98 so as to provide additional connecting openings (a,b) and (b,c).

Mounted to the rear wall 98 of the housing 22 is an air circulating unit 100, made up of a variable speed fan 102 and a box-like structure 104 defining a plenum chamber 106. The fan 102 draws in ambient air which passes into the plenum chamber 106, and from the plenum chamber 106 into the rear ends of the lower and upper heat exchange passageways 92*a* and 92*e*, respectively. Thus, as can be seen in FIG. 7, the air flows forwardly through passageway 92*e*, downwardly through opening (d,e), thence rearwardly through passageway 92*d*, then downwardly through opening (d,c), and then forwardly through passageway 92*c* to pass outwardly through the forward louvers 34. In like manner, the air entering into the lower passageway 92*a* passes through opening (a,b), then rearwardly through passageway 92*b*, then upwardly through opening (b,c), and thence forwardly through passageway 92*c* to exit through the forward louvered openings at 34. The louvers at the openings 34 can be made adjustable to direct the outflow of air and/or control the amount of air flow as a means of controlling the rate of heat exchange.

Thus, it is readily apparent that the air passing through the passageways 92*a–e* is in heat exchange relationship with the outer surfaces of the tubular electrodes 40, so that the ambient air passing from the louvered openings 34 is heated, and the gaseous effluent passing upwardly through the tubular electrodes 40 is cooled. The heat exchange structure 88–106 described above is shown somewhat schematically, and it is to be understood that the precise arrangement, configuration and spacing of the various plates 88*a–f*, as well as the sizing and spacing of the tubular electrodes 40, would be arranged to optimize the heat transfer. Further, while this heat exchange structure is shown as using ambient air as the heat exchange medium, within the broader aspects of the present invention, other heat exchange mediums could be used, as well as other air flow patterns.

The fan 102 is provided with an on/off switch 108. Further, the fan 102 is provided with a speed control device, shown somewhat schematically at 110. This speed control device 110 is operatively connected (as indicated by broken line 111) to a temperature sensor, indicated schematically at 112, located in the passageway 92*c*. The control device 110 is arranged so that the rotational speed of the fan 102 is controlled to maintain the temperature of the effluent passing through the passageways defined by the tubular electrodes 40 within the appropriate limits to achieve the functions of the present invention. Alternatively, the temperature sensing element 112 could sense temperature of the gaseous exhaust or effluent passing through the tubular electrodes 40 directly or the temperature of one or more of the electrodes 40 themselves.

It is desirable to maintain the temperature of emission products passing through tubular electrodes 40 as low as economically practical in order to obtain the maximum heat therefrom, as well as to obtain maximum condensation of emission products onto the inner surfaces of electrodes 40. However, there is a countervailing cost of cooling the emission products to increasingly lower temperatures imposed by the size of fan needed, power requirements, and heat exchange properties of the materials comprising tubular electrodes 40. A point exists therefore where the cost of cooling the tubular electrodes 40 to increasingly lower temperatures outweighs any additional heat recovered from the emission products. In order to provide optimum heat exchange between the heated emission products and cooling air, tubular electrodes 40 are constructed from a noncorrosive electrically conductive, heat conductive material. Candidates for the material are stainless steel, copper, or aluminum.

Figure 6:
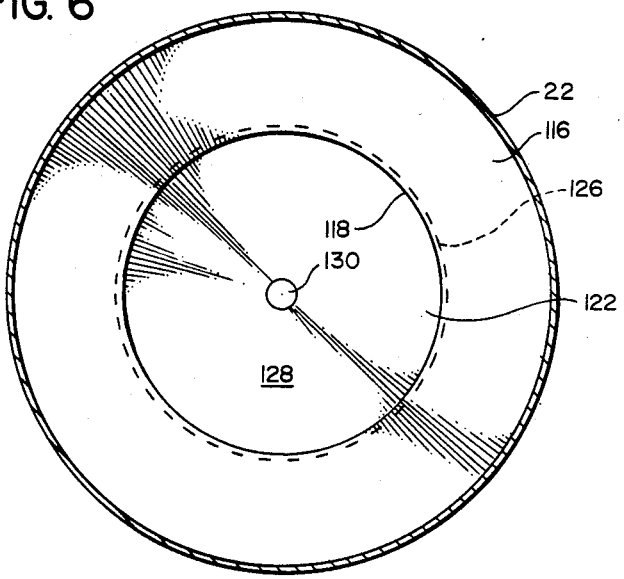
FIG. 6 is a cross-sectional view of the apparatus taken along line 6—6 of FIG. 3.

With reference to FIGS. 3 and 6, to collect emission products which have condensed onto the inner surfaces of the electrodes 40 and flowed downwardly under the force of gravity, there is provided below the inlet end of the tubular electrodes 40 a first annular plate 116 which connects to the lower end of the cylindrical housing 22. The plate 116 has the form of a truncated cone and slopes downwardly and radially inwardly, with its inner edge 118 defining a central through opening 120 through which the emission products from the stove 14 pass. Positioned downwardly from the plate 116 is a removable tray 122 which is mounted to a centrally located tube 124. Alternatively, the tray could be supported by outwardly extending support arms. The tray 122 also has the configuration of a truncated cone and has an outer circumferential edge portion 126 which is spaced radially outwardly a short distance beyond the inner edge 118 of the plate 116. (See FIG. 6.) Thus, the condensed emission products which drop onto the plate 116 then pass over the lower inner edge 118 of the plate 116 to drop onto the upwardly facing surface 128 of the tray 122, while some of the condensed emission products drop directly onto the tray 122. The condensed emission products collecting on the tray 122 can in turn flow downwardly into a central through opening 130 of the tube 124. These condensed products which fall through the tube 124 can then be burned in the firebox or combustion chamber 16. Alternately, the opening 130 could be closed by the tray 122 so that the condensed emission products are collected in the tray 122. Then, the tray 122 could be removed periodically and the collected emission products disposed of in some suitable manner, or possibly burned in the stove 14.

The arrangement of the tray 122 and the plate 116 is such that it permits the emission products to pass upwardly, first around the outer edge 126 of the tray 122, then through the annular gap defined by the plate edge 118 and the tray edge 126, and then upwardly through the central opening 120 defined by the plate 116. Obviously, the particular arrangement of the plate 116 and tray 122 could be modified to optimize the flow pattern of the effluent from the firebox 16 and to provide for convenient disposal of the collected emission products. Further, while the precise arrangement for removal of the tray 122 has not been illustrated, it is obvious that provisions could be made for convenient removal, such as a door provided in the housing portion 24 through which the tray 122 could be removed.

Referring now to FIG. 4, the diameter of each disc electrode 44 ranges in size from 0.2 to 0.5 (preferably 0.35 to 0.45) times the diameter of the inner circumference of tubular electrode 40, with the resulting distance between the outer perimeter 48 of disc electrode 44 and the inner surface of tubular electrode 40 defined as a distance of one electrode gap. The cross-sectional area of disc-like electrode 44 is about 0.04 to 0.25, preferably 0.1 to 0.2, times the inner cross-sectional area of electrode 40 at the location of disc-like electrode 44. The edge radius of disc electrode 44 ranges from 1/20 to 1/128 inches (preferably 1/32 to 1/64 inches). The diameter of support electrode 42 ranges from 0.25 to 0.8, preferably 0.3 to 0.4, times the diameter of disc electrode 44. Any projections or breaks in the surrounding structure capable of emitting an inner corona current is 0.75 times the difference between the inner diameter of tubular electrode 40 and that of disc electrode 44. Although for illustration purposes isolation housing 74 is shown as having a larger diameter than that of tubular electrode 40, the above-described relationships apply as well to the isolation housing 74 and its disc electrode 44. The axial distance between adjacent disc electrodes 44 ranges from one to two electrode gaps, preferably 1.25 to 1.75 electrode gaps.

In a prototype constructed in accordance with the present invention, the length of each of the tubular electrodes 40 was each fifteen inches, and the diameter of each tubular electrode 40 was 1.5 inches. The lower disc-like electrode 44 was positioned approximately six to eight inches below the top edge of the related tubular electrode 40, and the upper disc electrode 44 was positioned three to five inches below the top edge of the tubular electrode 40. In the event that a third disc-like electrode 44 would be added, this would be positioned approximately an inch from the top of the tubular electrode 40.

To describe the operation of the present invention, let us first review generally how a fire would be lit in the stove 10, and how this burning fire might progress through an entire 24 hour period. After that, the operation of the apparatus 10 in conjunction with the operation of the stove 14 will be discussed in more detail.

It can be assumed that the apparatus 10 is installed in the flue 12 of the wood stove 14, as shown in FIG. 1. The fire is started in the stove 14 in the usual manner, such as by placing crumpled paper or other fire starter in the bottom part of the firebox 16, piling kindling on top of the paper, and then placing several relatively dry logs or split dry logs on top of the kindling. To start the fire, the air vent device 20 will normally be in a full open position. In the first several minutes, the kindling will quickly ignite, and in turn heat the logs, with the exposed surfaces of the logs eventually beginning to burn. Moisture is driven from the logs, and after a short period of time, some of the volatiles in the logs (and, also volatiles in the kindling) begin to pass upwardly in the firebox 16 and into the flue 12. During this startup period, the gaseous effluent is often clearly visible as smoke and contains a relatively high percentage of unburned hydrocarbons. Further, some of the evaporated moisture begins to condense as the gaseous effluent flows upwardly in the flue 12.

After a period of time, the logs begin to burn more vigorously, and the temperature in the firebox 16 rises. On the assumption that the wood being burned is relatively dry (which as indicated previously means that the wood may still contain as much as 20% moisture by weight), the fire will generally begin to burn somewhat more cleanly, and the smoke of the gaseous effluent becomes less visible. Quite likely the temperature of the gaseous effluent passing out the chimney will become greater, but unfortunately the heat contained in this higher temperature effluent represents a certain percentage of lost heat that is "going up the chimney".

Quite commonly the stove 14 will burn at a higher temperature until the room is brought to a desired temperature, after which the vent 20 is closed down to limit the combustion to a level where the heat generated in the firebox 16 is adequate to keep the room at a reasonable temperature. By so limiting the inflow of air for combustion, it commonly happens that the gaseous effluent will become more "smoky", and the temperature of the effluent passing through the flue or chimney will decline. As indicated previously, this represents an inefficiency in that there is likely a greater percentage of the volatiles which do not undergo combustion, and also creates the problem of these volatiles condensing on the flue or chimney in the form of creosote.

If the fire continues to burn throughout the day, when the person tending the stove retires for an evening's sleep, the person will commonly stack up wood in the firebox 16 to the highest level and close the vent 20 so that very little combustion air is permitted to enter into the firebox 16. The purpose of this is to enable the stove to generate at least a certain amount of heat through the night hours, and also, hopefully, to have wood still burning in the stove 14 in the morning, so that additional wood can be placed on the fire to be ignited, thus eliminating the bother of starting the fire from scratch. It is during these night hours that the smoke can be particularly polluting, and the deposit of creosote on the inside surface of the flue or chimney more severe. Further, it can sometimes happen that the person will replenish the fire in the morning by stacking the firebox 16 full of wood, and then turn the vent 20 to the full open position. The fire then begins burning very briskly, and the temperature in the flue rises to possibly several hundred degrees. As indicated previously, this can sometimes ignite the deposited creosote and cause a chimney fire.

Let us review this same sequence of events, but let us further assume that the apparatus 10 has been activated by turning the switch 45 and the switch 108 to the "on" position, so that the electrodes 41 become negatively charged (e.g. to about 12 kilovolts), and so that the fan 102 is able to operate. Depending upon the nature of the control device 110, the fan 102 may immediately begin turning at a lower speed so as to blow air through the heat exchange passageways 92*a–e* more slowly, or it may turn on only after the temperature in the apparatus 10 has reached a sufficiently high level.

As the smoke 10 from the fire in the firebox 16 travels upwardly through the flue section 12, it then passes into the passageways 46 defined by the tubular electrodes 40 of the precipitator units 38. Since the apparatus 10, including the tubular electrodes 40, is at this time at a relatively low temperature (i.e. well below 212° F.), some of the moisture passing upwardly through the flue section 12 and into the passageways of electrode 40 will condense. Some of the volatiles which may be emitted will also condense, and some of these will be absorbed in the condensed water. The condensed droplets, along with particulate material (e.g. solid particulate hydrocarbons), will become negatively charged as these pass by the annular gaps 50 in the precipitator units 38. Then these negatively charged droplets and particles will migrate from the negative electrode 41 and collect on the inner surfaces 52 of the tubular electrodes 40. As the water, creosote and other liquid material collects on the electrode surfaces 52, these flow by gravity downwardly to be collected in the tray 116, or possibly descend through the tube 124 to drop into the combustion chamber 16.

As the fire in the firebox 16 begins to burn more briskly, the gaseous effluent passing upwardly into the apparatus 10 rises to a higher temperature. This in turn is sensed by the thermostat 112 which operates through the control device 110 to cause the fan 102 to operate at a higher rate of speed to circulate the ambient air more rapidly through the heat exchange chambers 92*a–e*.

In the preferred embodiment shown herein, the disc-like electrodes 44 are positioned in the middle and upper portion of the tubular electrodes 44. Thus, the emission products passing up through the lower portions of the tubular electrodes 40 will be in heat exchange relationship with the air passing through the lower passageways 92*a–c* prior to passing by the intense electrostatic fields created at the location of the disc electrodes 44. This arrangement enables a greater percentage of the emission products to be condensed before being subjected to the intense electrostatic field.

It has been discovered that the action of the precipitator units 38 in electrostatically charging the emission products, in addition to removing undesired pollutants, significantly enhance heat transfer to the ambient air flowing through the passageways 92*a–e*. Thus, there is the synergistic effect of simultaneously accomplishing the removal of moisture and particulate material from the effluent so as to remove contamination from the effluent discharged into the atmosphere, and also the more efficient extraction of heat from the effluent. In addition, there is the further benefit that volatiles (e.g. creosote) are caused to become deposited at a location where these can be recovered and utilized as fuel (or otherwise disposed of) as well as being removed as possible pollutants.

It is believed that various phenomena interact to enhance this heat transfer function, and while in all likelihood all of these phenomena are not fully understood (and possibly all of them not even identified), the following hypothesis can be proposed with some justification.

First, the fact that condensed moisture droplets are being deposited on the tubular electrodes 40 means that this moisture is being removed from the airstream and is placed in direct contact with the tubular electrodes 40 so as to facilitate heat transfer. Further, the removal of the moisture from the effluent passing further upwardly in the tubular electrodes 40 would require less extraction of heat to lower the temperature of the effluent yet further by a certain increment of temperature. Also, it is believed that the electrostatic ion flow to the wall of the tubular electrode 40 disrupts the laminar flow of gasses along the inner surface of the tubular electrodes 40, thereby resulting in a higher coefficient of heat transfer.

Quite possibly, the above explanation is an oversimplification of all the phenomena involved, and there are likely simultaneous interactions occurring in the same zone. However, regardless of the accuracy or correctness of the above hypothesis, it has been found by experimental results that the present invention does promote effective heat exchange between the emission products and the cooling air, thereby extracting additional heat while increasing the removal of contaminants from the emission products and alleviating at least to some extent the problems of unwanted deposits of creosote or the like on the walls of the flue or chimney.

Another quite significant factor in the present invention is that the removal of pollutants from the emission products is best accomplished under conditions where the potential pollution problem from the emission products is most severe. More specifically, when the fire is initially starting, or when the air vent has been closed down to slow the rate of burning of the wood, the resultant effluent is a very smoky effluent passing up the flue at a relatively low temperature. It is under these circumstances that the present invention can work very effectively in removing the pollutants. As disclosed in Example 3 below, under conditions simulating the overnight burning of a wood burning stove (i.e. where the stove is stacked full of wood and the air vent closed to permit only a small amount of bleed air to enter the firebox), the present invention was found to be extremely effective in removing undesired emission products. In the particular test described in Example 3, the present invention was able to remove more than 98%, and nearly as high as 99% of the undesired emission products.

To demonstrate the effectiveness of the present invention, the following tests were performed:

EXAMPLE 1

The apparatus of the present invention previously disclosed herein and illustrated in greater detail in FIG. 3 was connected to the discharge flue of a Model MK-2 Victorian Wood Burning Stove having a firebox volume of approximately 3.3 cubic feet and manufactured by Osburn Corp. of Victoria, BC, Canada. Mostly alderwood mixed with some fir was burned in the stove; the temperature of the stove was indicated by a thermometer extending into the exhaust flue at about five inches above the top wall of the stove. The temperature was regulated by opening and closing a slide-damper to control the amount of air entering the firebox in order to maintain a temperature of approximately 500°-600° F. therein, as measured in the flue about 2 inches above the top wall of the stove. The temperature of emission products as measured by a thermometer extending through the shell of the housing 22 at outlet 28 was between 140°-180° F. A voltage of approximately 12 KV at 2 milliamps was delivered to disc electrodes 44 soon after the wood was first ignited. An analysis of the emission products from the heating stove was made by using a Condor model 14-3 emission testing device manufactured by Condor Company, Hiram, Ohio, 44234.

Approximately ninety minutes after start-up of the fire in the firebox, power to disc electrodes 44 was terminated (precipitator off), but the fan circulating the heat exchange air remained running. Almost immediately the temperature at outlet 28 began to increase at least 30°-50° F. above the temperature previously registered at outlet 28 when current was being delivered to disc electrodes 44. Any further increase in temperature was prevented by resupplying current to disc electrodes 44 in order to prevent burning the emission products collected on the inner surfaces of tubular electrodes 40.

Data reflecting specific outlook temperatures before and after activating disc electrodes 44 is as follows:

| | Outlet Temperature (°F.) from the unit 10 | |
|---|---|---|
| Run No. | Precipitator On | Precipitator Off |
| 1 | 190° | 246° |
| 2 | 140° | 185° |

An analysis of the emission products when current to disc electrodes 44 was on revealed the following:

| Stove Sample Time (Minutes) | Exit Temperature At the stove (Degrees F.) | Contaiminant Output (Grams of hydrocarbon/ kilograms of burning wood) |
|---|---|---|
| 30 | 460° | 1.86 |

EXAMPLE 2

Figure 2:
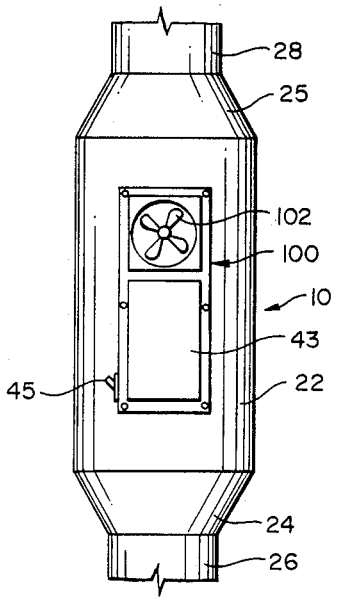
FIG. 2 is a rear elevational view of the present invention.

The apparatus of the present invention previously disclosed herein and illustrated in greater detail in FIG. 2 was connected to the discharge flue of a Model Regent 1000 Wood Burning Stove having a firebox volume of approximately 2.93 cubic feet and manufactured by Osburn Corp. of Victoria, BC, Canada. Mostly alderwood mixed with some fir was burned in the stove; the temperature was indicated by a thermometer extending into the firebox. The temperature was regulated by opening and closing a slide-damper to control the amount of air entering the stove in order to maintain a temperature of approximately 500°-600° F. therein. A voltage of approximately 12 KV at 2 milliamps was delivered to disc electrode 44 soon after the wood was first ignited. The analysis of the emission products was accomplished by using the previously described Condor model.

This analysis of the emission products when current to disc electrode 44 was on revealed the following:

| Stove Sample Time (Minutes) | Exit Temperature At the stove (Degrees F.) | Contaiminant Output (Grams of hydrocarbon/ kilograms of burning wood) |
|---|---|---|
| 30 | 480° | 0.5 |

EXAMPLE 3

The apparatus of the present invention previously disclosed herein and illustrated in great detail in FIG. 3 was connected to the discharge flue of a model Victorian MK 2 and tested with a Condor model 14-3 as previously described in Example 1. In this test, the unit was loaded with wood and banked for an overnight burn. The damper was moved to the closed position so that only a small amount of bleed air entered the firebox. (These are the conditions under which the stove is expected to produce the greatest amount of smoke.) The exit temperature at the flue of the firebox at the time of closing the damper was 620° F. After the temperature had dropped to 400° F. and stabilized, the testing was started.

The test was accomplished by monitoring the emissions output for a first 35 minute period, and then for a second 35 minute period, during which time the unit was operating (i.e. the current was on). Then the contaminant output during these two 35 minute periods was averaged to obtain the test results. The unit was then turned off (i.e. the current to the unit shut off, but the fan circulating the heat exchange air remained running). The emissions were monitored for a 15 minute period. The results were as follows:

| Stove Sample Time (Minutes) | Exit Temperature (Degrees F.) | Contaiminant Output (Grams of hydrocarbon/ kilograms of burning wood) |
|---|---|---|
| | (Precipitator On) | |
| 35 | 400° | 00.12 |
| | (Precipitator Off) | |
| 15 | 430° | 10.33 |

Thus, it can be seen that under these conditions when the apparatus of the present invention was operating, the reduction in contaminants that were emitted from the apparatus of the invention were reduced more than eighty times, as compared to the contaminants which pass through the apparatus of the present invention when it is not in its operating condition (i.e. when the current is turned off).

It has been found that it is desirable to maintain the temperature of the emission products as low as is practical in order to condense the greatest amount of emission products; more specifically it is desirable to maintain the temperature of the effluent in the tubular electrodes 40 below 180° F., and preferably below 160° F.

A second embodiment of the present invention will now be described with reference to FIGS. 8–10. Components of this second embodiment which correspond to components of the first embodiment will be given like numerical designations, with a prime (') designation distinguishing those of the second embodiment.

Thus, the unit 10' comprises a main housing 22' having lower and upper tapered portions 24' and 25', respectively, and also lower and upper cylindrical inlet and outlet portions 26' and 28', respectively. There are a plurality of precipitator units 38'. For ease of illustration, these precipitator units 38' have been illustrated by showing only the outer tubular electrode, it being understood that there would be a support electrode and disc electrode, such as described in the previous embodiment, where these components were designated as 42 and 44, respectively.

In the present embodiment, the housing 22' has a box-like configuration, where its width dimension (i.e. the dimension extending from side to side) is greater than its depth dimension (i.e. the dimension from forward to rear). The precipitator units 38' are arranged in two laterally extending rows in a forward housing chamber 140 defined by the housing 22'. In addition, the housing 22' defines a rear bypass chamber 142. The housing 22' has a middle partition wall 144 separating the forward chamber 140 from the rear chamber 142.

Pivotally connected at 146 to the lower edge of the partition wall 144 is a damper plate 148. This damper plate 148 can be moved about its pivot axis at 146 by means of a handle 149 mounted to the side of the housing 22'. The damper plate 148 is shown in its forward position in FIG. 9 so that it closes off the passageway 150 leading to the precipitator units 38'. By moving the damper plate 148 to its rearward position where it would engage the rear housing wall 152, the passageway 154 leading into the bypass chamber 142 can be closed.

Figure 8:
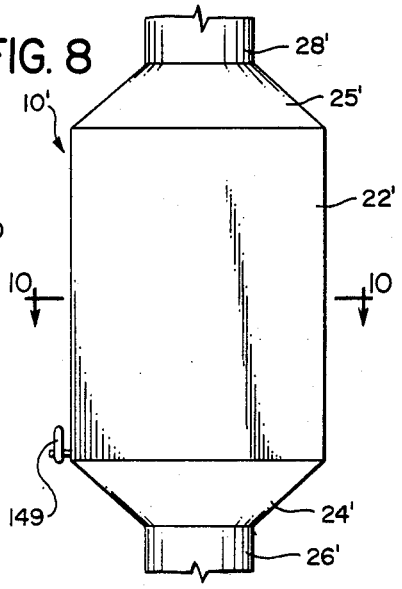
FIG. 8 is a front elevational view of a modified form of the present invention.
Figure 9:
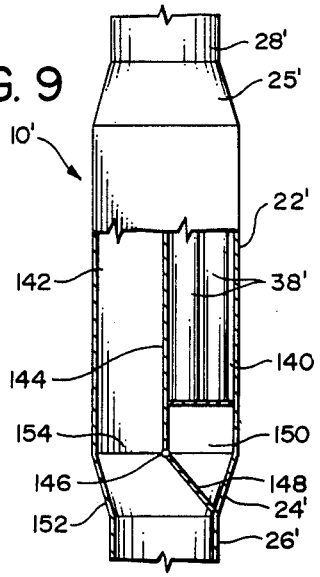
FIG. 9 is a side elevational view of the apparatus of FIG. 8, with a portion of the side wall broken away.
Figure 10:
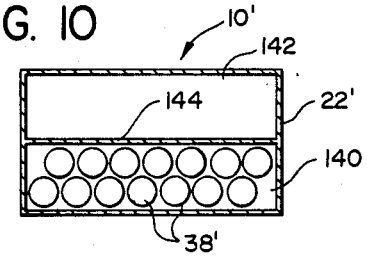
FIG. 10 is a sectional view taken along line 10—10 of FIG. 8.

The operation of the embodiment shown in FIGS. 8–10 is as follows. During those periods where the temperature of the emission products is at a lower level (this being the condition where a greater amount of undesired pollutants are produced, the damper plate 148 can be moved to its rear position to close off the passageway 154 and open the passageway 150. Thus, all of the emission products are directed through the precipitator units 38'.

When the fire in the firebox 16 is burning more briskly so that the emission products are discharged at a much higher temperature, the damper plate 148 can be moved to the forward position, as illustrated in FIG. 9. This enables the emission products to bypass the precipitator units 38' and flow upwardly through the bypass chamber 142. One reason for this arrangement is that this can protect the precipitator units 38' and the other components of the apparatus 10' from undesired exposure to rather high temperatures. Also, when the fire is burning more briskly so that the temperature of the emission products is much higher, there is generally less of a problem with respect to discharging pollutants into the atmosphere.

Figure 7:
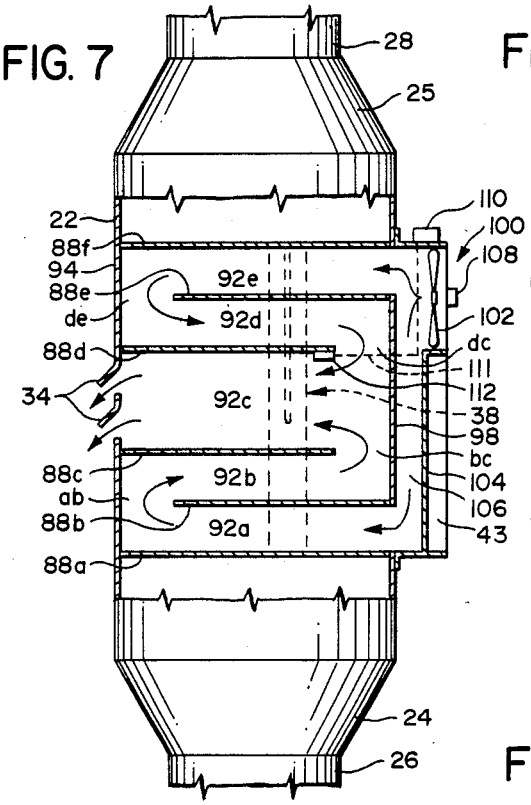
FIG. 7 is a partial cutaway side view of the apparatus illustrating the heat exchange system of the present invention, with the electrodes being omitted for clarity of illustration.

It is to be understood that the embodiment shown in FIGS. 8–10 can be provided with a suitable heat exchange system, such as illustrated in FIG. 7. For example, a pair of fans could be provided on opposite sides of the housing 22' to direct ambient air through the chamber 140 so as to be in heat exchange contact with the precipitator units 38'. This heat exchange air could then be directed outwardly through louvers provided in the front of the housing 22'. Likewise, suitable heat exchange devices could be provided to extract heat from the emissions passing through the bypass chamber 142.

Figure 11:
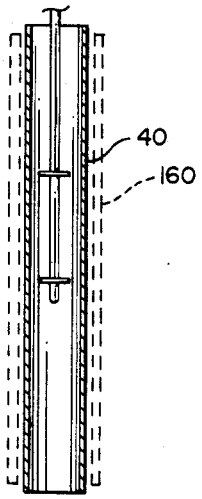
FIG. 11 is a schematic side elevational view of a tubular electrode of the present invention with a heating jacket being shown somewhat schematically.

A further embodiment of the present invention will now be described with reference to FIG. 11. Under some circumstances, it may be desired to heat the tubular electrodes 40 so that emission products which have collected as solids on the tubular electrode 40 could be liquified so that these would flow downwardly off the tubular electrodes 40. To accomplish this, the tubular electrode 40 is surrounded with a heating jacket 160, indicated schematically in broken lines. This heating jacket 160 could comprise, for example, an electric heating coil. Further, this jacket 160 could be arranged so that it would provide adequate openings for flow of heat exchange air to come into contact with the tubular electrode 40.

Thus, when the apparatus 10 of the present invention is not in use (i.e. when there is no fire in the stove 14), the heating jacket 160 could be activated to raise the tubular electrode to the desired temperature to cause the accumulated emission products on the inner surface of the electrode 40 to become liquid and flow downwardly from the electrode 40.

Figure 12A:
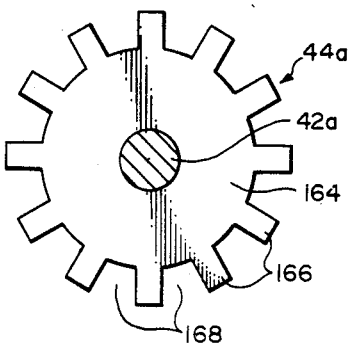
FIGS. 12*a* and 12*b* are a plan views of an alternative form of a disc electrode which can be used in the present invention.

In FIGS. **12*a* and 12*b*, there are shown modified configurations of the disc electrode 44. The arrangement in FIG. 12*a* is designated 44*a*, and it can be seen that the disc electrode 44*a* contains a main disc portion 164 mounted to a center support electrode 42*a*. Positioned around the circumference of the main disc portion 164 are a plurality of outwardly extending members 166. As shown herein, these members 166 each have a generally rectangular configuration and are spaced moderately from each other around the circumference of the main disc portion 164 so as to provide spaced circumferential openings 168. It has been found that this particular configuration permits a greater flow area for the gaseous product, while at the same time providing very good corona discharge for the desired charging of the particles in the gas stream flowing around the electrode 44*a***.

Figure 12B:
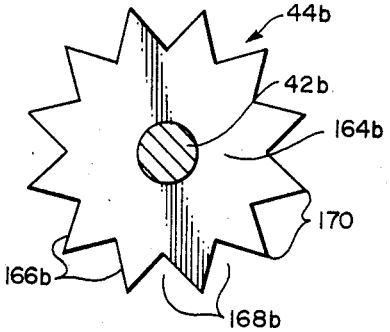

A modified version of the disc electrode 44*a* is shown in FIG. 12*b*, where there is a center main disc portion 164*b*, and a plurality of triangularly shaped elements 166*b*. The triangular elements 166*b* have radially outward corona discharge points 170. Further, these elements 166*b* provide for gaps 168*b* which permit the flow of gaseous discharge through the gaps 168*b*.

The arrangement of the disc electrodes illustrated in FIGS. 12*a* and 12*b* are disclosed herein to insure that the applicants herein are making a full and adequate disclosure of the preferred form of practicing the present invention. However, it is to be understood that the configuration of the disc electrodes shown in FIGS. 12*a*–12*b* are the independent invention of one of the co-inventors herein, namely Mr. Dan A. Norman, and it is intended that these will be claimed independently in a separate application, naming Mr. Norman as the sole inventor.

While particular embodiments of the apparatus and methods of the present invention have been disclosed herein, it will be readily apparent to persons skilled in the art that numerous changes and modifications can be made without departing from the spirit and scope of the invention. For example, the above invention has been described with reference to an electrostatic precipitator comprising a disc cathode positioned within a tubular anode. It should be appreciated that within the broader scope of the present invention, other types of electrostatic precipitators may be utilized, such as the wire cathode/tubular anode electrostatic precipitator or the two parallel spaced plate connecting a common wire cathode electrostatic precipitator, both of which were discussed previously. Further, with regard to various mechanical details of the present invention, the apparatus 10 can be arranged so that the precipitator 36, as well as other components of the apparatus 10, could be conveniently removed for cleaning and/or maintenance. Other modifications and deletions affecting portions of the present invention are envisioned without departing from the scope thereof.

What is claimed is:

1. A method of treating emission products resulting from burning wood, where the following conditions exist:

a. the wood is burned in a combustion chamber of a wood burning stove, for producing heat for a building structure;

b. rate of combustion of the wood is controlled by selectively limiting air intake into the combustion chamber in a manner that emission products from the burning wood contain, during at least a portion of time period when the fuel product is burning, an excess amount of incompletely burned hydrocarbons above a predetermined content level, with said hydrocarbons being liquid within a predetermined temperature range;

said method comprising:

a. directing the emission products from the stove through an electrostatic precipitator unit on a through path where the emission products flow between a first electrode and a second electrode, said first electrode having a first collecting surface along which the emission products flow;

b. charging the second electrode negatively to a predetermined voltage level relative to the first electrode to create corona discharge from the second electrode to cause material, including at least a portion of the excess incompletely burned hydrocarbons, to become deposited on the collecting surface of the first electrode;

c. causing the deposited material to be removed from the first collecting surface of the first electrode at least partially by positioning the first electrode so that the first collecting surface has a substantial vertical component of alignment, and at least part of the deposited material is in a liquid state and is removed by gravity flow from the first collecting surface.

2. The method as recited in claim 1, wherein the emission products which flow from the electrostatic precipitator are directed through conduit means and then discharged, with the electrostatic precipitator removing incompletely burned hydrocarbons from the emission products so as to inhibit coating of incompletely burned hydrocarbons on the conduit means.

3. The method as recited in claim 1, wherein under conditions where the emission products are above a predetermined temperature level, the emission products are bypassed around said precipitator unit, and with the emission products being at a temperature below said predetermined level, the emission products are directed through the electrostatic precipitator.

4. The method as recited in claim 1, further comprising maintaining temperature at the first electrode at a level where the deposited material on the first electrode is at least partially liquid, and the deposited material flows by gravity from the first surface of the electrode.

5. The method as recited in claim 4, further comprising providing tray means at a location vertically below said first electrode, and collecting in the tray means the material which move downwardly from the first surface of the first electrode.

6. The method as recited in claim 4, further comprising positioning said precipitator unit so that at least a portion of the deposited material that moves downwardly from the first surface of the first electrode moves to the combustion chamber of the stove for at least further partial combustion of the material.

7. The method as recited in claim 4, wherein there is moisture in the emission products, and the temperature at the first electrode is maintained at a level below the boiling point of water, whereby at least a portion of the moisture is condensed and collects on the first surface of the first electrode to cause as at least part of the deposited material to flow downwardly therefrom.

8. The method as recited in claim 7, further comprising providing tray means at a location vertically below said first electrode, and collecting in the tray means the material which moves downwardly from the first surface of the first electrode.

9. The method as recited in claim 7, further comprising positioning said precipitator unit so that at least a portion of the deposited material that moves downwardly from the first surface of the first electrode moves downwardly to the combustion chamber of the stove for at least further partial combustion of the material.

10. The method as recited in claim 1, further comprising passing a heat exchange medium in heat exchange relationship with a second heat exchange surface of said first electrode to maintain the temperature of the first electrode at the level where material collecting on the first electrode is at least partially liquid, and then utilizing heat imparted to the heat exchange medium as useful heat energy.

11. The method as recited in claim 10, wherein there is moisture in the emission products, and the heat exchange medium is passed in heat exchange relationship to maintain the temperature of the first electrode below the boiling point of water, so that condensed water collects on the first surface of the first electrode.

12. The method as recited in claim 10, wherein said first electrode is a tubular electrode, and said second electrode is positioned within said first electrode, said first surface being an interior surface of the first tubular electrode, and said second surface being an exterior surface of the first tubular electrode, and wherein said heat exchange medium is passed around the second outer surface of the first tubular electrode.

13. The method as recited in claim 12, wherein there are a plurality of precipitator units, with the first electrodes of each of said precipitator units being tubular electrodes, said method further comprising passing said heat exchange medium through heat exchange passageways extending between the first electrodes of the precipitator units.

14. The method as recited in claim 13, further comprising directing ambient air as the heat exchange medium which is passed through the heat exchange passageways, and then discharging said air as hot air for heating.

15. The method as recited in claim 14, wherein said temperature of the first electrode is maintained at a level below the boiling point of water, whereby condensed moisture is collected on the first surfaces of the first electrodes.

16. The method as recited in claim 14, further comprising utilizing fan means to cause air to flow through said heat exchange passageways, and further comprising controlling flow of air to maintain the temperature of the first electrodes within a predetermined range to cause the collected material on the first electrodes to be at least partially liquid.

17. The method as recited in claim 16, wherein said temperature of the first electrode is maintained at a level below the boiling point of water, whereby condensed moisture is collected on the first surfaces of the first electrodes.

18. The method as recited in claim 1, wherein said first electrode is a tubular electrode defining the through path through which the emission products flow, and said second electrode is positioned within said first electrode, said second electrode having at least a portion thereof extending radially outwardly from a center location within the first tubular electrode to form a radially outward corona discharge edge portion of the second electrode, said method further comprising charging said second electrode to form a radially outwardly expanding electrostatic field to enhance electrostatic precipitation and enhance collection of the incompletely burned hydrocarbons on the first collecting surface of the first electrode.

19. The method as recited in claim 18, wherein there are a plurality of precipitator units having first and second electrodes arranged in accordance with the recitations of claim 17, and said emission products is directed through the first electrodes of the plurality of precipitator units.

20. The method as recited in claim 19, wherein a heat exchange medium is passed between the first electrodes of the plurality of precipitator units so as to be in heat exchange relationship therewith so as to maintain the first electrodes at a temperature where at least a portion of the material collected on the first surfaces of the first electrodes remains liquid, said method further comprising orienting said first electrodes so that the liquid formed flows downwardly from the first electrodes.

21. The method as recited in claim 20, wherein said heat exchange medium is passed in heat exchange relationship with the first electrodes to maintain the temperature of the first electrodes below the boiling point of water, whereby moisture in the emission products is caused to collect as condensed moisture on the first surfaces of the first electrode.

22. The method as recited in claim 21, wherein air is directed between the first electrodes to be in heat exchange relationship therewith, and the air used as a heat exchange relationship is used to provide useful heat energy.

23. The method as recited in claim 21, wherein said first electrodes have lower electrode portions and upper electrode portions, said second electrode being positioned within said upper electrode portions, said method further comprising passing said heat exchange medium in heat exchange relationship with both the upper and lower first electrode portions, whereby the emission products are cooled prior to passing through the electrostatic field provided by the second electrodes.

24. A combination wood burning stove and pollutant removal/heat exchange apparatus, wherein:

a. said stove comprises:
   1. a housing defining a burning chamber in which wood can be burned;
   2. exhaust conduit means defining an exhaust passageway to carry emission products from the burning chamber, with said emission products containing at least part of the time, an excess of incompletely burned hydrocarbons which are liquid within a predetermined temperature range;
   3. air intake control means to control inflow of air into said burning chamber as a means of controlling rate of combustion of the wood;

b. said apparatus being arranged to provide for the emission products a flow through passageway communicating with the exhaust passageway of the exhaust conduit means, said apparatus comprising:
   1. a support housing;
   2. a first electrode mounted to the support housing and having a first collecting surface and a second heat exchange surface, said first electrode being positioned so that the emission products flowing through the apparatus flow adjacent to the first collecting surface;
   3. a second electrode positioned relative to the first electrode so that the emission products flow between the first collecting surface and the second electrode;
   4. voltage supply means operatively connected to the second electrode to charge the second electrode negatively to a predetermined voltage level relative to the first electrode to create corona discharge from the second electrode to cause material including at least a portion of incompletely burned hydrocarbons in the emission products to become deposited on the first collecting surface of the first electrode;
   5. said apparatus being provided with heat exchange means to direct a heat exchange medium adjacent said second heat exchange surface so as to be in heat exchange relationship with the emission products passing adjacent to the first collecting surface of the first electrode, in a manner to extract heat from the emission products, to maintain temperature at said first electrode at a temperature level no higher than said predetermined temperature range at least part of the time, and to direct said heat exchange medium from the heat exchange means;

6. the first electrode being positioned so that the first collecting surface has a substantial vertical component of alignment, with a portion of the deposited material being removed by gravity flow from the first collecting surface.

25. The combination as recited in claim 24, wherein the first electrode is positioned so that the first collecting surface has a substantial vertical component of alignment, with a portion of the deposited material is removed by gravity flow from the first collecting surface.

26. The combination as recited in claim 25, wherein said heat exchange means is arranged to maintain at least part of the time the temperature at the first electrode at a level below the boiling point of water, whereby at least a portion of moisture in the emission products is condensed and collects on the first surface of the first electrode as at least part of the deposited material to flow downwardly therefrom.

27. The combination as recited in claim 26, further comprising tray means at a location vertically below said first electrode to collect the deposited material which moves downwardly from the first surface of the first electrode.

28. The combination as recited in claim 26, wherein said first electrode is positioned so that at least a portion of the deposited material that moves downwardly from the first surface of the first electrode moves downwardly to the combustion chamber of the stove for at least further partial combustion of the material.

29. The combination as recited in claim 24, wherein said first electrode is a tubular electrode, and said second electrode is positioned within said first electrode to form an electrostatic precipitator unit, said first surface being an interior surface of the first tubular electrode, and said second surface being an exterior surface of the first tubular electrode, said heat exchange means being arranged so that said heat exchange medium is passed around the second outer surface of the first tubular electrode.

30. The combination as recited in claim 29, wherein there is a plurality of precipitator units, with the first electrodes of each of said precipitator units being tubular electrodes, said heat exchange means being arranged so that said heat exchange medium passes through heat exchange passageways extending between the first electrodes of the precipitator units.

31. The combination as recited in claim 30, wherein said heat exchange means is arranged to direct ambient air as the heat exchange medium which is passed through the heat exchange passageways, said heat exchange means comprising air discharge means to discharge said air for heating.

32. The combination as recited in claim 31, further comprising fan means to cause air to flow through said heat exchange passageways, and further comprising control means responsive to temperature in said apparatus to control flow of air to maintain the temperature of the first electrodes within a predetermined range to cause the deposited xaterial on the first electrodes to be at least partially liquid.

33. The combination as recited in claim 32, wherein the heat exchange means is arranged to maintain temperature of the first electrode at a level below the boiling point of water, whereby condensed moisture is collected on the first surfaces of the first electrodes.

34. The combination as recited in claim 24, wherein said first electrode is a tubular electrode defining the through path through which the emission products flow, and said second electrode is positioned within said first electrode to form a precipitator unit, said second electrode having at least a portion thereof extending radially outwardly from a center location within the first tubular electrode to provide a radially outward corona discharge edge portion of the second electrode, to form a radially outwardly expanding electrostatic field to enhance electrostatic precipitation and enhance collection of the material on the first collecting surface of the first electrode.

35. The combination as recited in claim 34, wherein there are a plurality of precipitator units having first and second electrodes arranged in accordance with the recitations of claim 34, and said apparatus is arranged to direct said emission products through the first electrodes of the plurality of precipitator units.

36. The combination as recited in claim 35, wherein said heat exchange means is arranged so that said heat exchange medium is passed between the first electrodes of the plurality of precipitator units so as to be in heat exchange relationship therewith so as to maintain the first electrodes at a temperature where at least a portion of the material collected on the first surfaces of the first electrodes remains liquid, said first electrodes being oriented so that the liquid formed flows downwardly from the first electrodes.

37. The combination as recited in claim 36, wherein said heat exchange means is arranged so that the heat exchange medium is passed in heat exchange relationship with the first electrodes to maintain the temperature of the first electrodes below the boiling point of water, whereby moisture in the emission products is caused to collect as condensed moisture on the first surfaces of the first electrode.

38. The combination as recited in claim 31, wherein said heat exchange means is arranged to direct air between the first electrodes to be in heat exchange relationship therewith.

39. The combination as recited in claim 31, wherein said first electrodes have lower electrode portions and upper electrode portions, said second electrodes being positioned within said upper electrode portions, said heat exchange means being arranged so that said heat exchange medium is passed in heat exchange relationship with both the upper and lower first electrode portions, whereby the emission products are cooled prior to passing through the electrostatic field provided by the second electrodes.

40. The combination as recited in claim 24, further comprising conduit means to receive the emission products passing from the apparatus with the apparatus removing incompletely burned hydrocarbons from the emission products so as to inhibit coating of incompletely burned hydrocarbons on the conduit means.

41. The combination as recited in claim 24, wherein said apparatus comprises bypass means defining a bypass passageway to direct the emission products around said flow through passageway, said apparatus further comprising damper means selectively operable to direct emission products from the wood burning unit either through the electrostatic precipitator or through the bypass means.

42. The combination as recited in claim 24, wherein said wood burning unit further comprises selectively operable vent means to control flow of air into the burning chamber, whereby when said vent means limits air inflow to a lower level, there is an increase in incompletely burned hydrocarbons in the emission products.

43. The combination as recited in claim 24, wherein:

a. said support housing has a substantially closed side wall, and a lower inlet end and an upper outlet end;

b. said first electrode being a tubular electrode, with said second electrode being positioned within said first electrode to form with the first electrode an electrostatic precipitator unit, said apparatus comprising a plurality of such precipitator units positioned within said housing at predetermined spaced locations within said housing, and with the first electrodes defining therebetween heat exchange passageway means, upper and lower plate means being provided to enclose said heat exchange passageway means;

c. fan means mounted to said housing and arranged to direct ambient air into and through said heat exchange passageway means;

d. said housing being provided with air outlet means to direct heated air outwardly from said heat exchange passageway means.

44. The combination as recited in claim 43, wherein there is bus electrode means positioned above said first electrodes, and said second electrodes are mounted to said bus electrode means, said apparatus further comprising bus electrode support members extending downwardly from the bus electrode means, isolation housing means surrounding said bus electrode means, said isolation housing means comprising a vent opening through which heat exchange air can pass upwardly through said isolation housing means to purge emission products from said isolation housing means.

45. The combination as recited in claim 43, wherein there is provided in said housing a plurality of plate means extending horizontally across said housing and defining vertically spaced heat exchange passageway portions, said passageway portions being interconnected to provide for travel of heat exchange air sequentially through a plurality of said passageway portions.

46. The combination as recited in claim 45, wherein there is a first set of upper heat exchange passageway portions and a second set of lower heat exchange passageway portions, and said heat exchange means is arranged to direct ambient air as a separate air flow through said upper set of heat exchange passageways and also as a separate air flow through said lower set of heat exchange passageways.

47. The combination as recited in claim 43, wherein said heat exchange means further comprises variable speed fan means, and temperature responsive control means to control speed of said fan to cause greater or lesser amounts of heat exchange air to flow through the heat exchange passageways to maintain temperature at the first electrodes at a predetermined temperature level.

48. A pollutant removal/heat exchange apparatus adapted to be used in conjunction with a wood burning stove which comprises:

a. a housing defining a burning chamber in which a fuel product having the burning characteristics of wood can be burned;

b. exhaust conduit means defining an exhaust passageway to carry emission products from the burning chamber, with said emission products containing at least part of the time, an excess of incompletely burned hydrocarbons which are liquid within a predetermined temperature range;

c. air intake control means to control inflow of air into said burning chamber as a means of controlling rate of combustion of the wood;

said apparatus being arranged to provide for the emission products a flow through passageway communicating with the exhaust passageway of the exhaust conduit means, said apparatus comprising:

a. a support housing;

b. a first electrode mounted to the support housing and having a first collecting surface and a second heat exchange surface, said first electrode being positioned so that the emission products flowing through the apparatus flow adjacent to the first collecting surface;

c. a second electrode positioned relative to the first electrode so that the emission products flow between the first collecting surface and the second electrode;

d. voltage supply means operatively connected to the second electrode to charge the second electrode negatively to a predetermined voltage level relative to the first electrode to create corona discharge from the second electrode to cause material including at least a portion of incompletely burned hydrocarbons in the emission products to become deposited on the first collecting surface of the first electrode;

e. said apparatus being provided with heat exchange means to direct a heat exchange medium adjacent said second heat exchange surface so as to be in heat exchange relationship with the emission products passing adjacent to the first collecting surface of the first electrode, in a manner to extract heat from the emission products, to maintain temperature at said first electrode at a temperature level no higher than said predetermined temperature range at least part of the time, and to direct said heat exchange medium from the heat exchange means;

f. the first electrode being adapted to be positioned so that the first collecting surface has a substantial vertical component of alignment, with a portion of the deposited material being removed by gravity flow from the first collecting surface;

g. the first electrode being adapted to be positioned so that the first collecting surface has a substantial vertical component of alignment, with a portion of the deposited material being removed by gravity flow from the first collecting surface;

h. said heat exchange means being arranged to maintain at least part of the time the temperature at the first electrode at a level below the boiling point of water, whereby at least a portion of moisture in the emission products is condensed and collects on the first surface of the first electrode as at least part of the deposited material to flow downwardly therefrom; and i. said apparatus further comprising tray means at a location vertically below said first electrode to collect the deposited material which moves downwardly from the first surface of the first electrode.

49. A pollutant removal/heat exchange apparatus adpated to be used in conjunction with a wood burning stove which comprises:

a. a housing defining a burning chamber in which a fuel product having the burning characteristics of wood can be burned;

b. exhaust conduit means defining an exhaust passageway to carry emission products from the burning chamber, with said emission products containing at least part of the time, an excess of incompletely burned hydrocarbons which are liquid within a predetermined temperature range;

c. air intake control means to control inflow of air into said burning chamber as a means of controlling rate of combustion of the wood;

said apparatus being arranged to provide for the emission products a flow through passageway communicating with the exhaust passageway of the exhaust conduit means, said apparatus comprising:

a. a support housing;

b. a first electrode mounted to the support housing and having a first collecting surface and a second heat exchange surface, said first electrode being positioned so that the emission products flowing through the apparatus flow adjacent to the first collecting surface;

c. a second electrode positioned relative to the first electrode so that the emission products flow between the first collecting surface and the second electrode;

d. voltage supply means operatively connected to the second electrode to charge the second electrode negatively to a predetermined voltage level relative to the first electrode to create corona discharge from the second electrode to cause material including at least a portion of incompletely burned hydrocarbons in the emission products to become deposited on the first collecting surface of the first electrode;

e. said apparatus being provided with heat exchange means to direct a heat exchange medium adjacent said second heat exchange surface so as to be in heat exchange relationship with the emission products passing adjacent to the first collecting surface of the first electrode, in a manner to extract heat from the emission products, to maintain temperature at said first electrode at a temperature level no higher than said predetermined temperature range at least part of the time, and to direct said heat exchange medium from the heat exchange means;

f. the first electrode being adapted to be positioned so that the first collecting surface has a substantial vertical component of alignment, with a portion of the deposited material being removed by gravity flow from the first collecting surface;

g. said apparatus further comprising bypass means defining a bypass passageway to direct the emission products around said flow through passageway, said apparatus also comprising damper means selectively operable to direct emission products from the wood burning unit either through the electrostatic precipitator or through the bypass means.

50. A pollutant removal/heat exchange apparatus adapted to be used in conjunction with a wood burning stove which comprises:

a. a housing defining a burning chamber in which a fuel product having the burning characteristics of wood can be burned;

b. exhaust conduit means defining an exhaust passageway to carry emission products from the burning chamber, with said emission products containing at least part of the time, an excess of incompletely burned hydrocarbons which are liquid within a predetermined temperature range;

c. air intake control means to control inflow of air into said burning chamber as a means of controlling rate of combustion of the wood;

said apparatus being arranged to provide for the emission products a flow through passageway communicating with the exhaust passageway of the exhaust conduit means, said apparatus comprising:

a. a support housing;

b. a first electrode mounted to the support housing and having a first collecting surface and a second heat exchange surface, said first electrode being positioned so that the emission products flowing through the apparatus flow adjacent to the first collecting surface;

c. a second electrode positioned relative to the first electrode so that the emission products flow between the first collecting surface and the second electrode;

d. voltage supply means operatively connected to the second electrode to charge the second electrode negatively to a predetermined voltage level relative to the first electrode to create corona discharge from the second electrode to cause material including at least a portion of incompletely burned hydrocarbons in the emission products to become deposited on the first collecting surface of the first electrode;

e. said apparatus being provided with heat exchange means to direct a heat exchange medium adjacent said second heat exchange surface so as to be in heat exchange relationship with the emission products passing adjacent to the first collecting surface of the first electrode, in a manner to extract heat from the emission products, to maintain temperature at said first electrode at a temperature level no higher than said predetermined temperature range at least part of the time, and to direct said heat exchange medium from the heat exchange means;

f. the first electrode being adapted to be positioned so that the first collecting surface has a substantial vertical component of alignment, with a portion of the deposited material being removed by gravity flow from the first collecting surface;

g. said support housing having a substantially closed side wall, and a lower inlet end and an upper outlet end;

h. said first electrode being a tubular electrode, with said second electrode being positioned within said first electrode to form with the first electrode an electrostatic precipitator unit, said apparatus comprising a plurality of such precipitator units positioned within said housing at predetermined spaced locations within said housing, and with the first electrodes defining therebetween heat exchange passageway means, upper and lower plate means being provided to enclose said heat exchange passageway means;

i. fan means mounted to said housing and arranged to direct ambient air into and through said heat exchange passageway means;

j. said housing being provided with air outlet means to direct heated air outwardly from said heat exchange passageway means;

k. said heat exchange means further comprising variable speed fan means, and temperature responsive control means to control speed of said fan to cause greater or lesser amounts of heat exchange air to flow through the heat exchange passageways to maintain temperature at the first electrodes at a predetermined temperature level.

* * * * *